US005103658A

United States Patent [19]

McQuade

[11] Patent Number: 5,103,658

[45] Date of Patent: Apr. 14, 1992

[54] SELF LOCKING GATE LATCH

[76] Inventor: Donald E. McQuade, 56 Jefferson St., Red Bank, N.J. 07701

[21] Appl. No.: 646,821

[22] Filed: Jan. 28, 1991

[51] Int. Cl.[5] ..... E05B 65/06

[52] U.S. Cl. ..... 70/77; 70/139; 49/394

[58] Field of Search ..... 70/77, 91, 139; 49/394

[56] References Cited

U.S. PATENT DOCUMENTS

| | | | |
|---|---|---|---|
| 303,225 | 8/1884 | Jordan . | |
| 315,284 | 4/1885 | Hewitt . | |
| 1,168,234 | 1/1916 | Tausch . | |
| 1,179,852 | 4/1916 | Louden . | |
| 1,319,187 | 10/1919 | Sumners . | |
| 1,429,389 | 9/1922 | Weintz . | |
| 2,074,759 | 3/1937 | Richards . | |
| 2,194,408 | 3/1940 | Sluss . | |
| 2,510,520 | 6/1950 | Remmele . | |
| 2,577,930 | 12/1951 | Thomas | 49/394 |
| 2,666,660 | 1/1954 | Youngworth . | |
| 2,809,063 | 10/1957 | Taylor . | |
| 2,953,916 | 9/1960 | Thomas | 70/77 |
| 3,042,435 | 7/1962 | Wiesler . | |
| 3,083,561 | 4/1963 | Sussing . | |
| 3,270,536 | 9/1966 | Sprung . | |
| 3,307,384 | 3/1967 | Sineruo . | |
| 3,355,207 | 11/1967 | Newman . | |
| 3,702,549 | 11/1972 | Splovieff et al. . | |
| 3,774,947 | 11/1973 | Duncan . | |
| 3,926,018 | 12/1975 | Joersz . | |
| 3,934,436 | 1/1976 | Candlin et al. . | |
| 4,387,916 | 6/1983 | Lening et al. . | |
| 4,592,578 | 6/1986 | Martin . , | |
| 4,691,541 | 9/1987 | McQuade | 70/77 |

FOREIGN PATENT DOCUMENTS 584589 2/1925 France .

*Primary Examiner*—Gary L. Smith
*Assistant Examiner*—Suzanne L. Dino
*Attorney, Agent, or Firm*—Weingram & Zall

[57] ABSTRACT

A gate latch is provided for locking a hingeably mounted gate to a latch post. A gate latch is mounted to either the gate or post by a mounting means. The mounting means extends from a lock housing having a locking means disposed therein. Extending from the housing is an oarlock means. The oarlock means is pivotal between a first locked position and a second unlocked position. The locking means automatically locks the oarlock means in the first locked position when the oarlock pivots from the second position to the first position. Also provided is a key lock means normally biased to a locked position which may be used to unlock the oarlock from the first lock position and permit the pivotal movement of the oarlock between the first and second positions.

8 Claims, 13 Drawing Sheets 106
48
44
124
120
46
122
130
110
116
116
156
160
168
170
178
182
112
164
180
114
71
154
126
133
108
158
162
166
132
163
128
176
172

566
528
574
574
551
550
551
588
535
586
538
536
604
606
544
546
620
608
626
672
582
540
548
545
622
633
630
534
590
571
526
558
612
562
650
651
556
578
554
552
602
600
61
60
671
670
678
542
671

SELF LOCKING GATE LATCH

BACKGROUND OF THE INVENTION

1. Field of the Invention

This invention relates to a gate lock for a fence, and more particularly, to a self locking, relatively high security gate lock for chain link fences.

2. Prior Art

Chain link fences are well known. Typically such fences include a frame having numerous poles disposed at fixed intervals which support a mesh of thick metal wire which forms a screen. The screen is typically secured to the poles by pieces of wire. To provide a gate in an opening between two poles of the chain link fence, a gate about the size of the opening is hingedly mounted to the pole or fence post on one side of the opening. An oarlock or fork latch is typically hingeably attached to the opposite pole of the gate. When the gate is moved to the closed position, the oarlock or fork latch is moved from a vertical position to a horizontal position where it receives the pole of the fence in the U-shaped portion of the oarlock.

Typically, to lock the gate when the oarlock is in the closed position, i.e. horizontal, openings in the lock and collar are provided which line up, and a padlock is passed through the openings to lock them in their aligned position. With the lock in place, the oarlock cannot be moved from the horizontal closed position to the vertical open position. Thus the gate is locked.

The drawbacks of such a method of locking a chain link gate include the difficulty and complexity in opening and closing the lock and gate, the potential to lose or misplace the lock, and the inherent weakness of the lock to tampering by an intruder. The loss of the lock occurs frequently because the padlock has to be removed from the gate to complete the locking and unlocking operation. Further, in order to unlock the gate, two hands must be used. One hand to hold and steady the lock and another hand for inserting the key to open the lock.

Further, of recent date many state and/or local governmental laws and/or regulations now specify that a self latching gate latch device is required for swimming pool areas. The aforedescribed type devices are not self latching and, when left unlocked, as they are apt to be, can be easily opened by children and can pose a substantial risk, particularly when used for swimming pool areas or other potentially hazardous areas.

U.S. Pat. No. 4,691,541 to the inventor herein, McQuade (hereinafter "McQuade '541") eliminates the risk of losing or misplacing the lock because the locking device is always attached to the gate frame. At no time is the lock removed from the gate. To open the lock one must simply insert the key and turn. When the lock is turned the lock cylinder releases the lock bar from the oarlock which locks the gate. The oarlock is then moved from its locked horizontal position to the vertical unlocked position.

Improvements to the security of the gate of McQuade '541, by the same inventor include the inventions described and claimed in U.S. Pat. No. 4,919,463 (hereinafter McQuade '463) and in copending application 07/461,169, filed Jan. 5, 1990, now U.S. Pat. No. 5,024,473 (hereinafter McQuade '473).

McQuade '463 describes a gate latch for a chain link fence which has an oarlock latch that is pivotal from a vertical position to a horizontal position, the oarlock having means thereon to lock the oarlock to the collar.

A means is also provided which is formed on the collar for interfitting with the locking means and for enclosing a portion of the oarlock to lock the oarlock to the collar and inhibit access to the enclosed portion of the oarlock.

McQuade '473 describes a similar gate locking device for a fence which includes a security box having a dead bolt means affixed to the security box whereby when the oarlock is moved to the horizontal locked position and the dead bolt is extended, the gate is securely locked to prevent unauthorized intrusion.

Other latch and lock devices are described in the following U.S. Pat. Nos.:

315,284 to Hewitt:
303,225 to Jordan;
1,168,234 to Tausch;
1,179,852 to Louden;
1,319,187 to Sumners:
1,429,389 to Weintz:
2,074,759 to Richards;
2,194,408 to Sluss:
2,510,520 to Remmele;
2,666,660 to Younoworth;
2,809,063 to Taylor:
3,042,435 to Wiesler:
3,083,561 to Sussing:
3,270,536 to Sprung:
3,307,384 to Sinervo
3,355,207 to Newman:
3,702,549 to Solovieff et al:
3,774,947 to Duncan:
3,926,018 to Joersz;
3,934,436 to Candlin et al;
4,387,916 to Lenino et al;
4,592,578 to Martin; and
French Pat. No. 584,589 to Hutin.

All of these aforecited patents are relatively complicated to lock and none of these references teach or suggest a self locking gate latch which, when the gate is swung closed, automatically locks to prevent the opening of the gate.

OBJECTS OF THE INVENTION

It is an object of this invention to provide a gate locking device for a chain link fence which automatically locks as the gate is swung closed.

It is another object of this invention to provide a gate locking device for a chain link fence which has a positive locking action similar to a dead bolt means.

It is yet another object of this invention to provide a gate locking device for a chain link fence which is easily locked and unlocked.

Another object is to provide a gate locking device for a chain link fence which is retrofittable on existing chain link fences.

It is a further object of this invention to provide a gate lock which automatically locks and is suitable for enclosing swimming pool areas and other potentially hazardous areas.

It is still a further object of this invention to provide a gate lock for a chain link type fence which not only automatically latches but automatically locks.

It is a further object of this invention to provide a gate lock for a chain link fence which can be easily installed on existing gate frame, without welding.

It is yet another object of this invention to provide a lock for a chain link fence which is easy to install, and does not shift or move when in use and the locking mechanism is completely enclosed in a lock box to protect it from the environment and for security.

It is a further object of this invention to provide a relatively inexpensive lock which is easy to install on a chain link fence.

It is a further object of this invention to provide a gate lock for installation on a gate which automatically swings closed, and automatically locks the gate in a closed position when the gate swings to the closed position and which can be easily opened with a key.

These and other objects of this invention are achieved with the gate latch mechanism of this invention for use in locking a hingedly mounted gate to a fence post. The gate latch comprises a lock housing; mounting means attached to the housing for mounting the housing to the gate or post; an oarlock means pivotally mounted to the housing, the oarlock means being pivotal between a first position and a second position, wherein when the oarlock is in the first position the oarlock extends from the housing to engage the other of the gate or post when the gate is in a closed position, and when the oarlock is in the second position it is disengaged from the other of the gate or post when the gate is in an opened position; and locking means within the lock housing for automatically locking the oarlock in the first position when the oarlock pivots from the second position to the first position, thereby preventing the oarlock from further pivoting, and thereby locking the gate in the closed position.

Preferably, the locking means comprises a key lock for unlocking the oarlock to permit the oarlock to pivot between the first and second positions, the key lock being rotatable between the first locked position for automatically locking the oarlock in the first position and a second unlocked position to permit the oarlock to pivot between the first and second positions. Preferably, the key lock automatically returns to the first locked position.

Preferably, an oarlock shaft is provided which has a first end mounted to the oarlock and a second end extending into and pivotally mounted to the housing and a lock bolt having a first end which coact with and is mounted to the key lock and a second end engageable with the second end of the oarlock shaft, wherein when the key lock is in the first locked position, the second end of the lock bolt is urged against the second end of the oarlock shaft to thereby engage the oarlock shaft and automatically lock the oarlock in the first position, and when the lock bolt is in the second unlocked position the second end of the lock bolt is disengaged from the second end of the oarlock shaft to thereby unlock the oarlock and permit the pivoting of the oarlock from the first position to the second position.

The foregoing and other objects, features and advantages of this invention will be apparent from the following description of the preferred embodiments of the invention as illustrated in the accompanying drawings.

DETAILED DESCRIPTION OF ONE EMBODIMENT OF THE INVENTION

Figure 1:
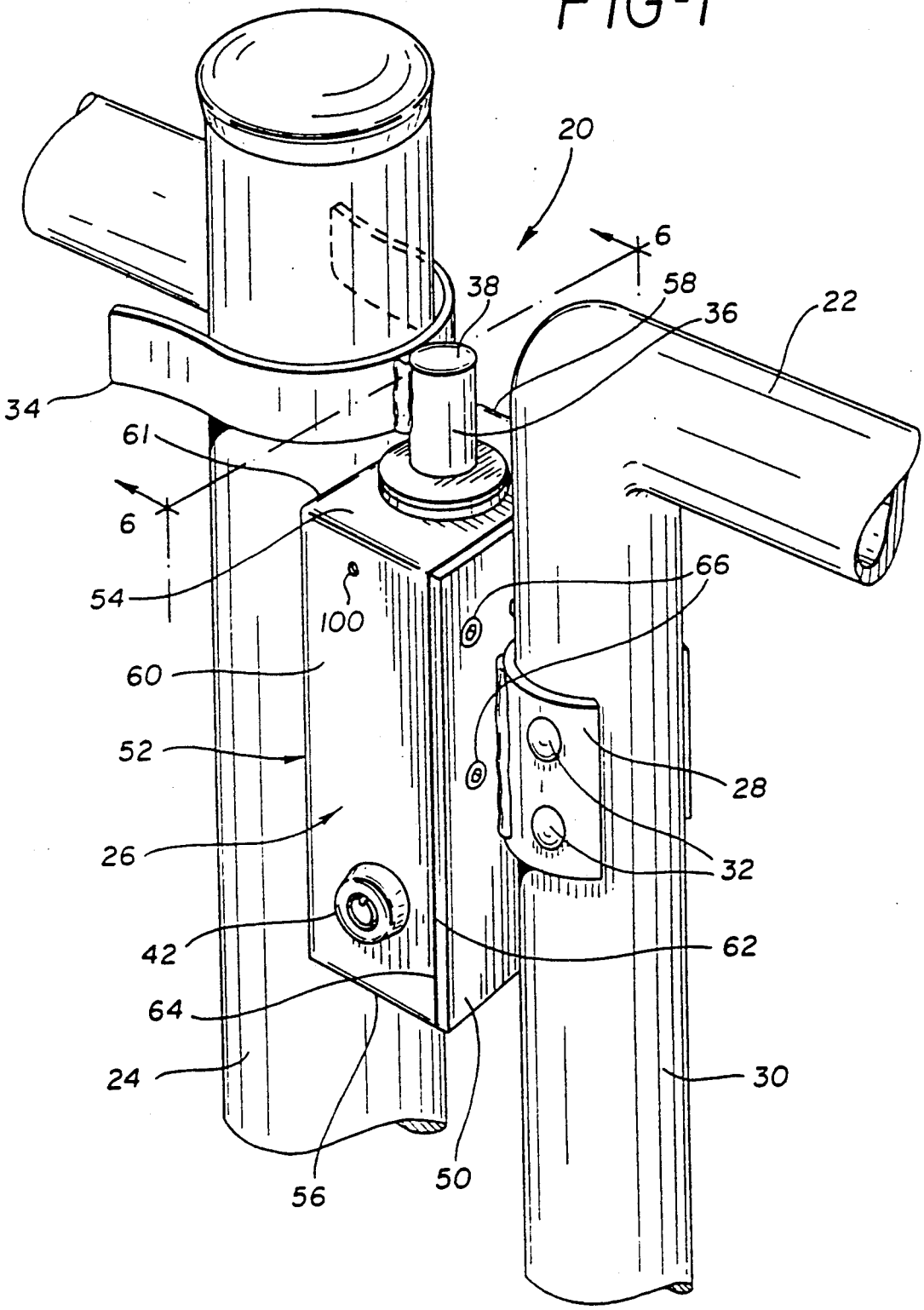
FIG. 1 is perspective view of one embodiment of the gate latch of this invention in a locked position.
Figure 2:
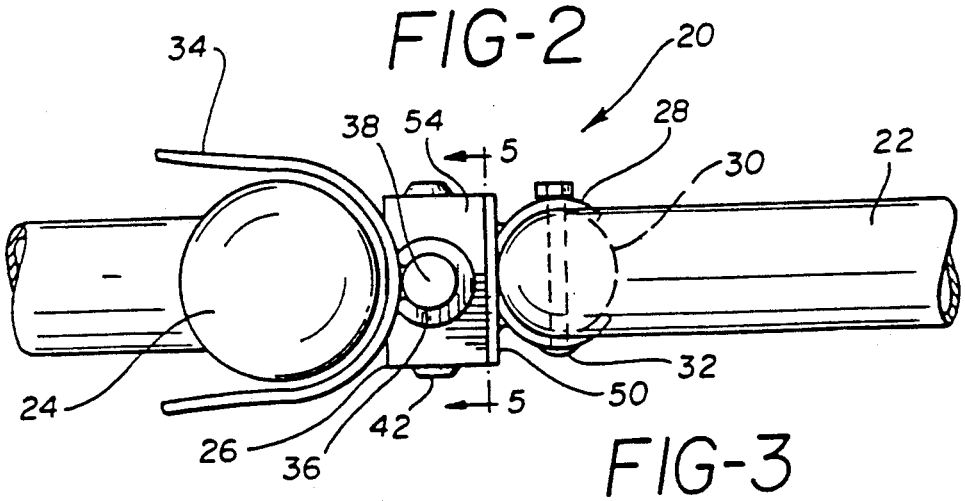
FIG. 2 is a top view of this embodiment of the gate latch of this invention in a locked position.
Figure 3:
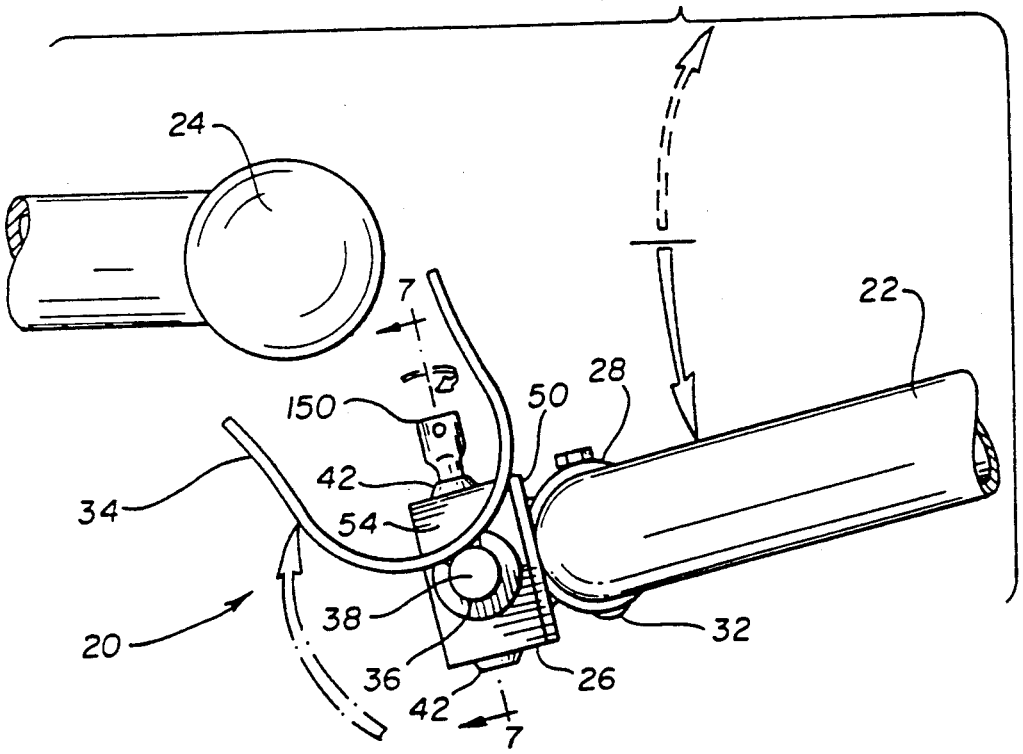
FIG. 3 is a top view of this embodiment of the gate latch of this invention in the unlocked position.
Figure 4:
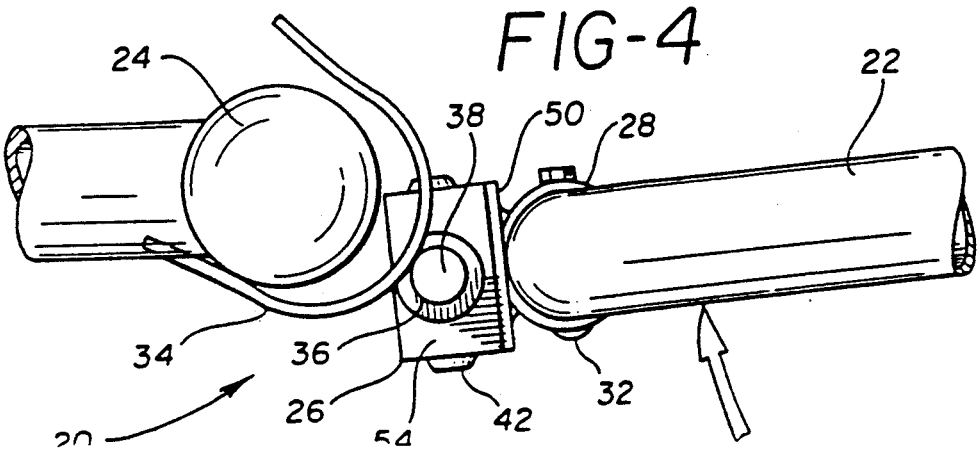
FIG. 4 is a top view of this embodiment of the gate latch of this invention just prior to the gate being closed and entering the locked position.

Referring to FIGS. 1-9, particularly, FIGS. 1 and 2, the gate latch 20 of this invention is used for locking a hingeably mounted gate 22 to a latch post 24 of a fence (not shown). The gate latch 20 comprises a lock housing 26 and a mounting means, for example a mounting collar 28, for mounting the lock housing 26 to either the gate post 30 of gate 22 or optionally (not shown) the latch post 24. In its preferred embodiment as shown, the lock housing 26 is mounted to a gate post 30. Preferably the mounting collar 28 is mounted to the gate post 30 by a plurality of carriage bolts 32.

An oarlock or fork latch means 34 is pivotally mounted to the lock housing 26. The oarlock 34 is mounted on an oarlock shaft 36, and pivots about an axis (not shown) extending vertically through the oarlock shaft 36. The oarlock shaft 36 has a first end 38 which is mounted to the oarlock 34 and a second end 40 (see, for example, FIG. 7) which extends into the lock housing 26. The shaft 36 is pivotally mounted in the lock housing 26, i.e. it can turn or rotate within the housing 26.

The oarlock 34 pivots in a horizontal plane between a first position, as shown, for example, in FIG. 2, wherein the oarlock 34 extends from the housing 26 to engage the latch post 24 when the gate 22 is in a closed position. The oarlock 34 also pivots to a second position, as shown, for example, in FIG. 3, wherein the oarlock 34 is disengaged from the latch post 24 when the gate 22 is in an opened position.

Although the preferred embodiment of this invention requires the oarlock 34 to pivot in a horizontal plane it is possible to construct an embodiment of this invention which pivots in a vertical plane.

Broadly, a locking means is enclosed within the lock housing 26 for automatically locking the oarlock 34 in the first locked position when the oarlock 34 pivots from the second unlocked position to the first locked position to prevent the oarlock 34 from pivoting further, and to lock the gate 22 in the closed position (see FIGS. 5-9).

Preferably, as the gate 22 swings from the open position (FIG. 3) to the closed position (FIG. 4) the interior of one side of the oarlock 34 contacts the latch post 24 (FIG. 4) to automatically pivot the oarlock 34 to the closed position while the gate 22 swings closed. Optionally, the gate may have a spring mechanism (not shown) of the type well known in the art, to automatically cause the gate 22 to swing closed. Such a gate when used in combination with the spring mechanism and gate latch 20 of this invention results in a gate that automatically swings closed and also automatically locks without any assistance from the operator.

The locking means included within the lock housing 26 comprises a key lock unit 42 for unlocking the oarlock 34 to permit the oarlock 34 to pivot from the first to the second position.

Figure 6:
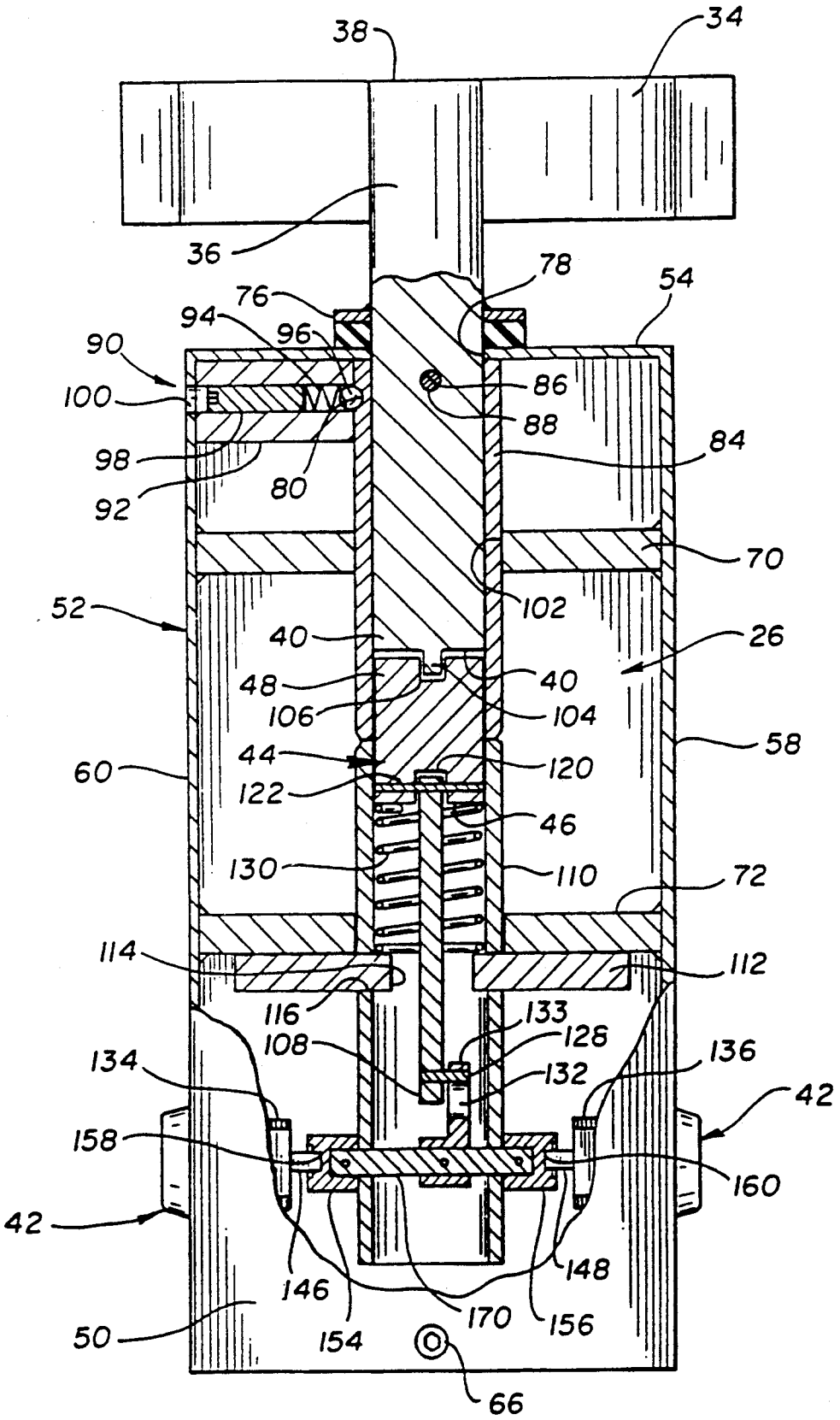
FIG. 6 is a partial cross sectional view of the gate latch of this invention in the locked position taken along line 6—6 of FIG. 1.

The key lock 42 is rotatable between a first locked position, as shown, for example, in FIG. 6, for automatically locking the oarlock 34 in the first position and a second unlocked position (see, for example, FIG. 7) to permit the oarlock 34 to pivot between the first and second positions. The locking means is designed so that they key lock 42 automatically returns to the first locked position from the second unlocked position when the key 150 is released and/or removed.

Referring to FIGS. 5-9, generally, within the lock housing 26 a lock bolt 44 is provided which has a first end 46 which coact with the key lock 42 and a second end 48 which is engageable with the second end 40 of oarlock shaft 36. The lock bolt 44 is urged by spring 130 into engagement with the second end 40 of oarlock shaft 36, except when key lock 42 is maintained in the second position by the application of constant pressure to the key 150.

Figure 5:
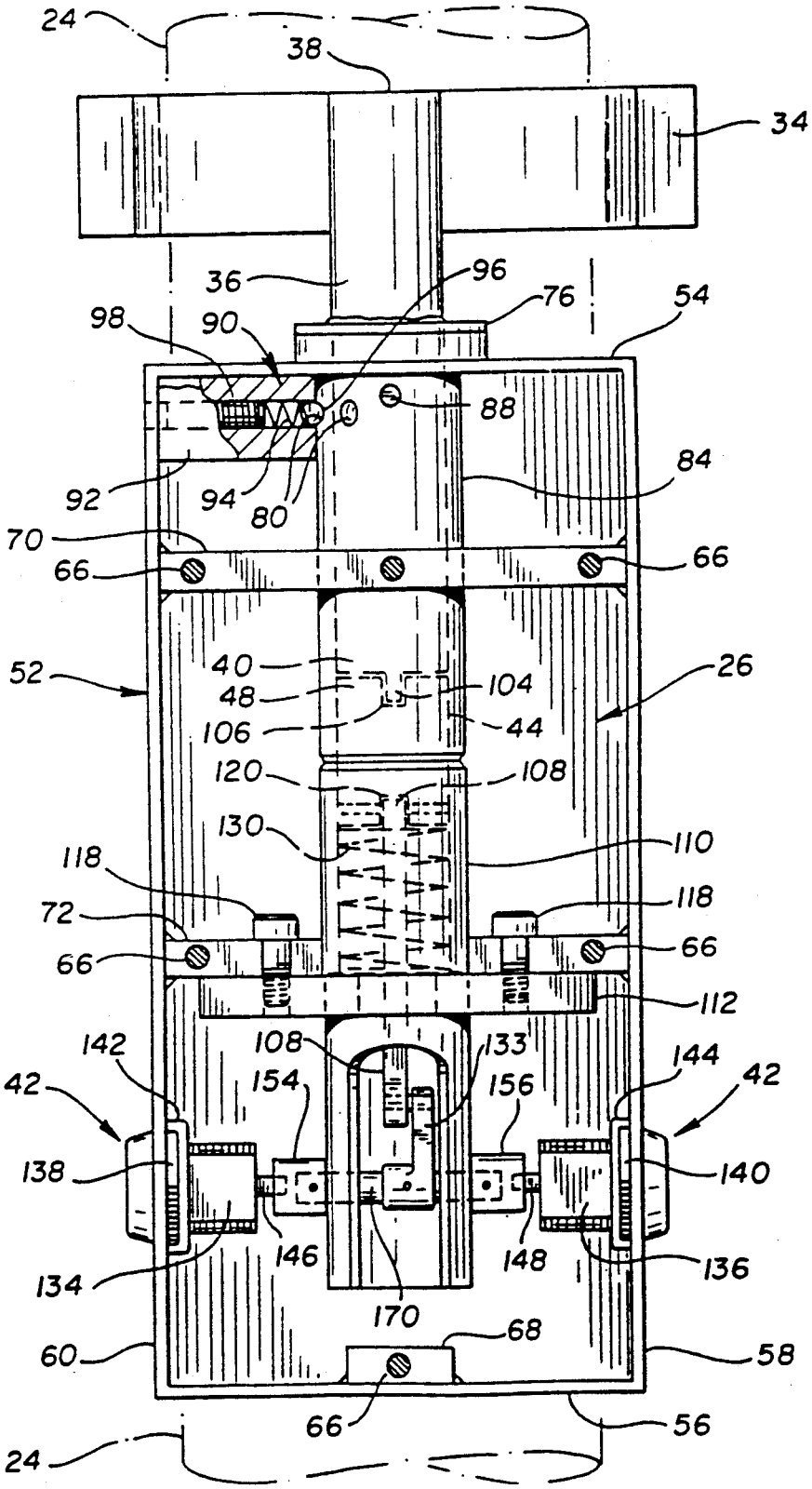
FIG. 5 is a cross sectional view of the gate latch of this invention in a locked position taken along line 5—5 of FIG. 2.
Figure 7:
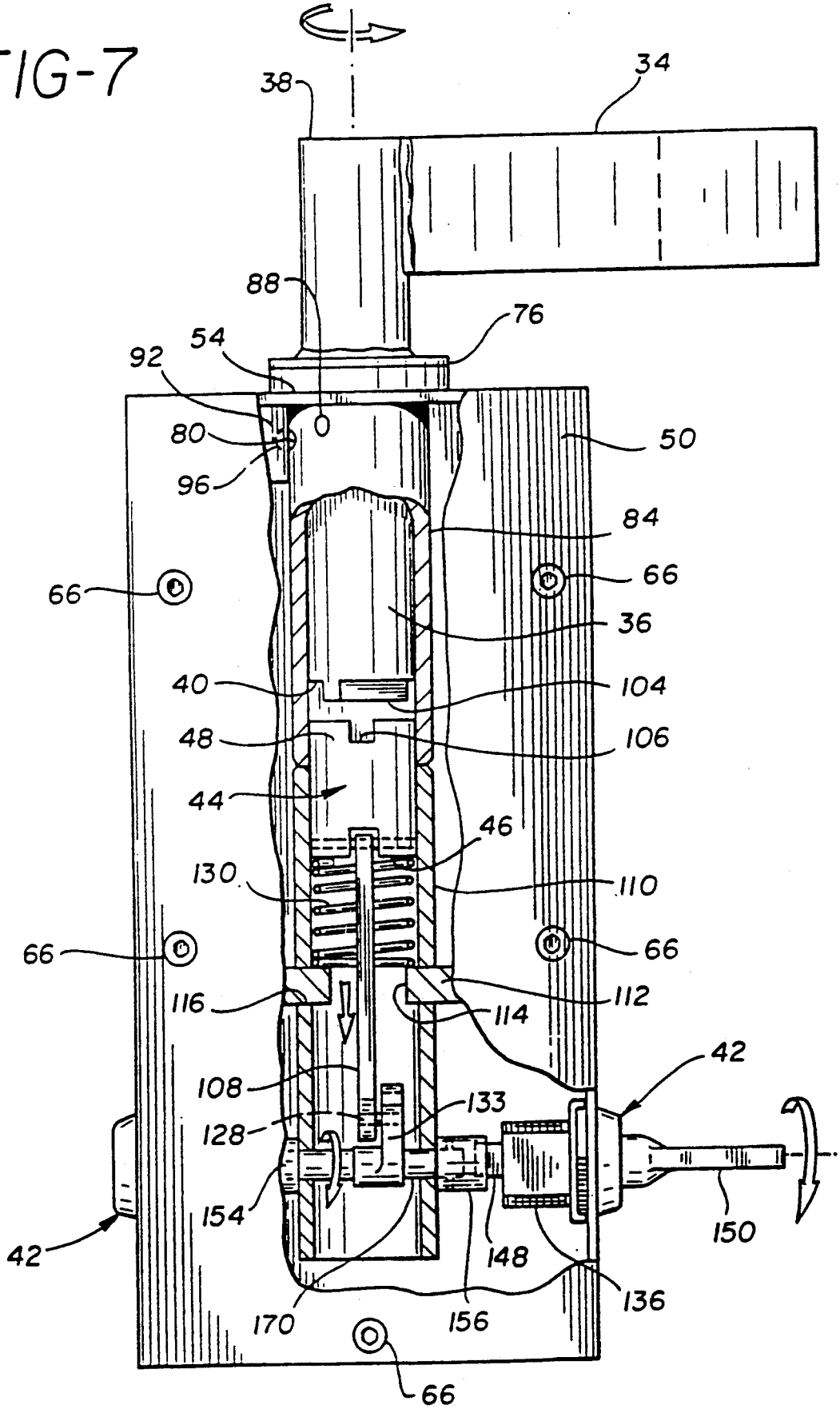
FIG. 7 is a partial cross sectional view of the gate latch of this invention in the unlocked position taken along line 7—7 of FIG. 3.

Referring to FIGS. 5-7, when the key lock 42 is in the first locked position, the second end 48 of the lock bolt 44 is engaged or urged against the second end 40 of the oarlock shaft 36 to cause the locking of the oarlock 34 when the oarlock 34 is in the first locked position (see, for example, FIG. 6). When the lock bolt 44 is urged to the second unlocked position by urging key 150 in the appropriate direction, (see, for example, FIG. 7) the second end 48 of lock bolt 44 is disengaged from the second end 40 of the oarlock shaft 36 to thereby unlock the oarlock 34 from the first position and allow the oarlock 34 to pivot from the first locked position to the second unlocked position, thus permitting the gate 22 to open.

More specifically, referring to FIGS. 5-9, the lock housing 26 comprises a rear cover plate 50 mounted to an enclosure housing 52 having a top 54 and bottom 56, a left side 58 and a right side 60, and a front 61 and rear side 62. The rear cover plate 50 has a gasket 64 mounted between the cover plate 50 and the rear 62 of enclosure housing 52 to prevent moisture and the elements from finding their way into the interior of the lock housing 26. The rear cover plate 50 is mounted to the enclosure housing 52 by a plurality of screws 66 which threadably engage a bottom mounting rib 68 and upper and lower mounting plates, 70 and 72, respectively to mount the gasket 64 and rear cover plate 50 firmly to the enclosure housing 52.

Attached to the rear cover plate 50 is a mounting collar 28. The mounting collar 28 preferably comprises removable mounting collar elements 28A and 28B. These collar elements 28A and 28B may initially be made removable from the rear cover plate 50 so that various size collar elements 28A and 28B may be utilized in order to mount the gate latch 20 to various size posts, e.g. gate post 30. The collar elements 28A and 28B may, although not necessarily, be welded to cover plate 50 to more securely fasten the gate latch 20 to the post 30 (see FIGS. 1-4). The Collar elements 28A and 28B have a plurality of holes 74 in each collar 28A, 28B to permit carriage bolts 32 to pass through the collar elements 28A and 28B and through holes that are drilled (not shown) in gate post 30, so that the collar 28 may be thereby secured to gate post 30.

Referring to FIGS. 5-8, mounted to the oarlock shaft 36 just below the oarlock 34 is an oarlock shaft retainer collar 76. This is permanently secured to the oarlock shaft 36, by for example welds around the periphery of the shaft 36, and overlies mounting hole 78 which passes through the top surface 54 of enclosure housing 52. The collar 76 insures that moisture, dust, etc. from the environment does not find its way into the lock housing 26. Circumferentially surrounding and mounted to oarlock shaft 36 is upper tubular shaft 84. Passing through upper tubular shaft 84 are diametric retaining holes 82. Passing through oarlock shaft 36 is retaining hole 86. Retaining hole 86 in oarlock shaft 36 aligns with retaining holes 82 in tubular shaft 84 to permit a retaining pin 88 to pass therethrough and secure the oarlock shaft 36 within upper tubular shaft 84. Tubular shaft 84 further has retaining 15 socket or indentations 80. Referring, for example to FIG. 6, a detente means, generally designated 90, is provided for substantially frictionally locking or maintaining the oarlock 34 in the second or opened position to thereby prevent the oarlock 34 from rotating past or through the position indicated in, for example, FIG. 3, and to control or maintain the oarlock 34 in the opened position.

Figure 8:
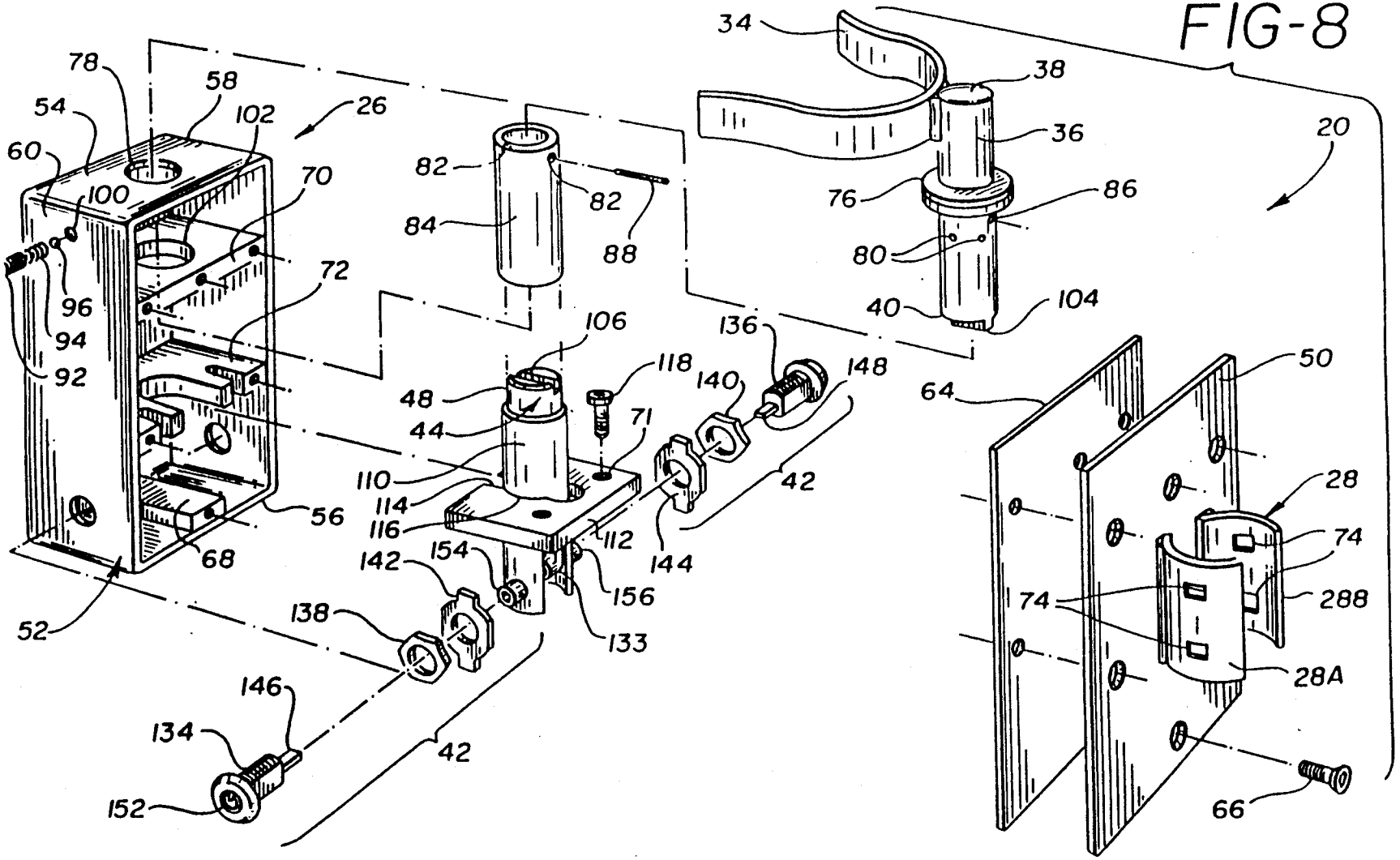
FIG. 8 is an exploded perspective view of this embodiment of the gate latch of this invention.

As shown more clearly in FIGS. 5, 6, and 8, the detente means 90 comprises a detente housing 92 having a detente spring 94 therein which urges against detente ball 96. An adjustment screw 98 threadably engages housing 92 to provide for adjustment of the tension in detente spring 94 by adjustment of screw 98 through the hole 100 in the left side 58 of housing 26. (See FIG. 1)

Referring to FIGS. 6 and 8, upper tubular shaft 84 is slidably maintained in opening 102 in upper mounting plate 70. Upper mounting plate 70 may be retained in the enClosure housing 52 by being welded therein along the periphery of the upper mounting plate 70.

Referring to FIGS. 5-9, at the end of oarlock shaft 36 is a tongue 104 which extends from the second end 40 of oarlock shaft 36. The tongue 104 is adapted to matingly engage with slot 106 in lock bolt 44.

Figure 9:
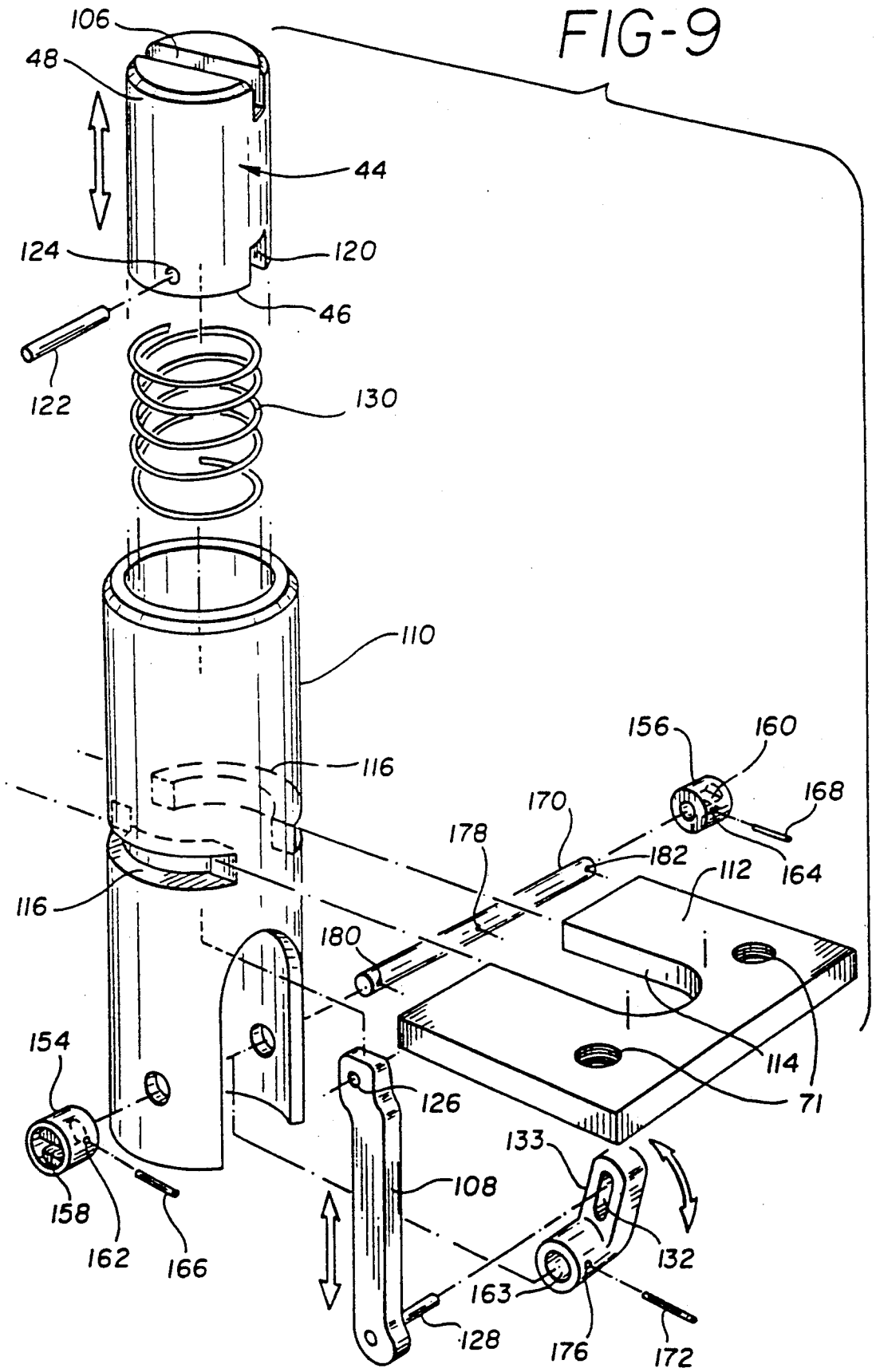
FIG. 9 is a partial exploded perspective view of this embodiment of the gate latch of this invention.

Referring to FIGS. 8 and 9, lock bolt 44 rides within lower tubular shaft 110. Lower tubular shaft 110 is retained within lock housing 26 by engagement with spring retainer plate 112. Retainer plate 112 has a slot 114 therein which matingly engages circumferential slots 116 in lower tubular shaft 110. The spring retainer plate 112 is retained in the loCk housing 26 by a plurality of mounting bolts 118 which pass through holes 71 in spring retainer plate 112 to engage the lower mounting plate 72.

Referring to FIGS. 8 and 9, at the lower end of lock bolt 44 a slot 120 is provided which has passing perpendicular therethrough a lock bolt pin 122 which is retained therein by lock bolt pin holes 124 in each shoulder of slot 120. Lock bolt pin 122 passes through a hole 126 at the Upper end of lock bolt arm 108 to pivotally attach lock bolt arm 108 to the lower end of lock bolt 44. Attached to the lower end of lock bolt arm 108 is a cam follower pin 128.

Surrounding lock bolt arm 108 is spring 130 which is retained upon stationary spring retainer plate 112 at one end, and at its other end, spring 130 urges lock bolt 44 upward towards the second end 40 of oarlock shaft 36 to urge engagement of tongue 104 with slot 106.

Referring to FIGS. 5, 6, 7, and 9, the follower pin 128 on lock bolt arm 108 engages slot 132 in cam 133. Cam 133 coact with key lock unit 42 in such a manner that when the key lock 42 is rotated between the first locked position (for automatically locking the oarlock 34 in the first position) and a second unlocked position (to permit the oarlock 34 to pivot between the first and second positions), the cam 134 causes cam follower pin 128 to raise or lower the lock bolt arm 108 to cause the slot 106 in lock bolt 44 to engage with or disengage from tongue 86 at the second end 40 of oarlock shaft 36. Spring 130 urging against spring retainer plate 112 and lock bolt 44 causes the lock bolt 44 to be constantly urged against shaft end 40 unless spring 130 is urged downward by the coaction of cam 133 and lock arm 108.

Referring to FIGS. 6–9, key lock unit 42 comprises a threadable lock plug, for example a D-shaped threaded lock plug 134 at each side which passes through each of the sides 58, 60 of the lock housing 26. A threaded lock plug nut 138, 140 is threaded over the respective lock plug 134, 136 and overlaying each of the lock plug nuts 138, 140 is a lock plug nut retainer 142, 144 which threadably engages lock plugs 134, 136 and retains the lock plug nuts 138, 140 thereon. Projecting from the center of each lock plug 134, 136 is a lock plug shaft 146, 148 which rotates when key 150 is placed into the key hole 152 and is turned. At the end of each lock plug shaft 146, 148 is a coupling 154, 156. One end of coupling 154, 156 has a slot 158, 160. This slot matingly engages with the end of lock plug shaft 146, 148. The other end of coupling 154, 156 has a retainer hole 162, 164 therein. Connecting shaft 170 connects these couplings 154, 156 and passes through opening 163 in cam 133 which is located in the Center of lower tubular shaft 110. Cam 133 is maintained on connecting shaft 170 by retaining pin 172 passing through cam retainer hole 176 and center hole 178 on shaft 170. Couplings 154, 156 are retained on shaft 170 by pin 166, 168 passing through holes 162, 164 and end holes 180, 182, respectively, in shaft 170.

In use, lock bolt 44 is urged upward by spring 130 causing cam follower pin 128 to cause the key lock 42 to be maintained in the first locked position and causing the upward urging of lock bolt 44 into engagement with tongue 104 of oarlock shaft 36. As oarlock 34 is pivoted from the second unlocked position to the first lock position by, for example contact latch post 24, the tongue 104 rotates, being urged against the shoulders of slot 106 until the tongue 104 engages slot 106. At this position the oarlock 34 is in a first locked position engaging the latch post 24. When the key 150 is rotated in the opposite direction, cam 133 moves cam follower pin 128 to lower lock bolt arm 108 against spring 130 to lower lock bolt 44 to disengage tongue 104 from slot 106 thus permitting the oarlock 34 to freely pivot from the first locked position to the second open position, permitting the gate 22 to open. When the key 150 is released the lock bolt 44 is automatically urged by spring 130 against the second end of oarlock shaft 40, tongue 104 overlying slot 106 and preventing engagement therebetween.

DETAILED DESCRIPTION OF ANOTHER EMBODIMENT OF THE INVENTION

Figure 10:
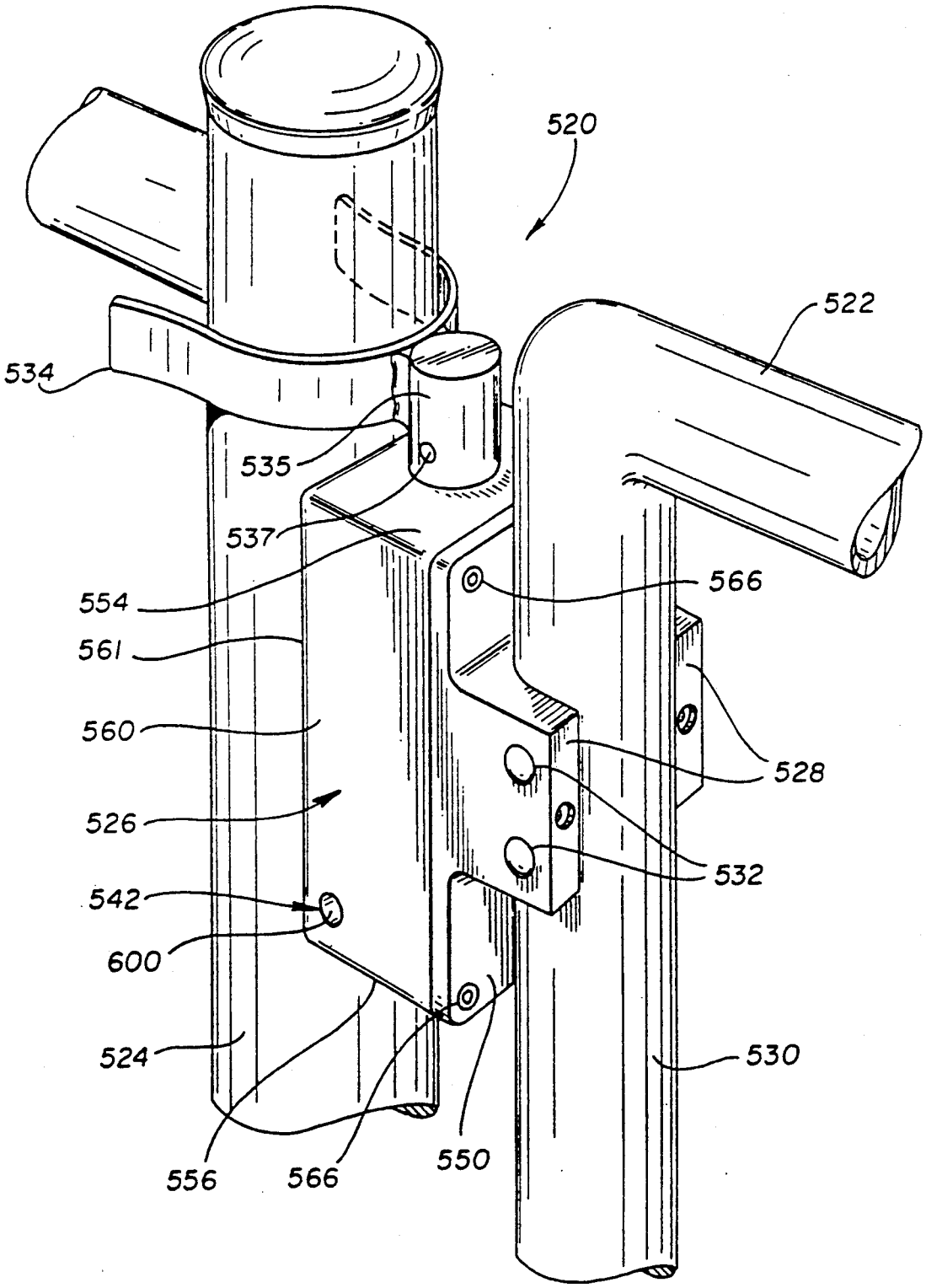
FIG. 10 is perspective view Of another embodiment of the gate latch of this invention in a locked position.
Figure 11:
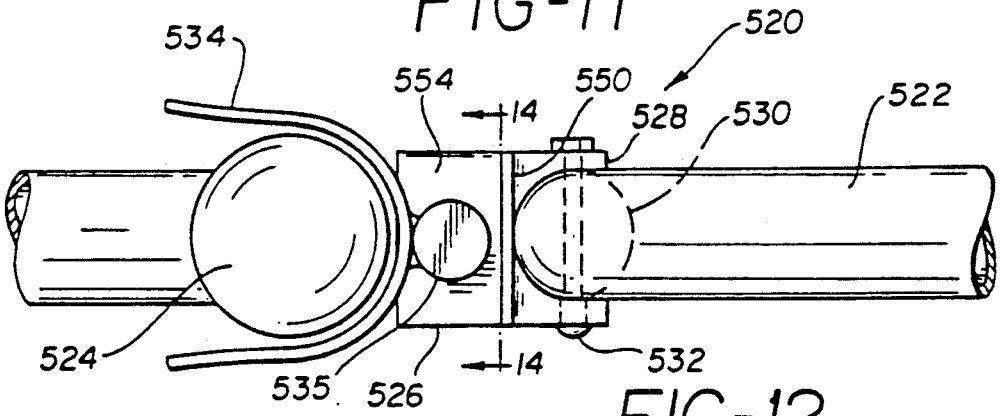
FIG. 11 is a top view of this embodiment of the gate latch of this invention in a locked position.
Figure 12:
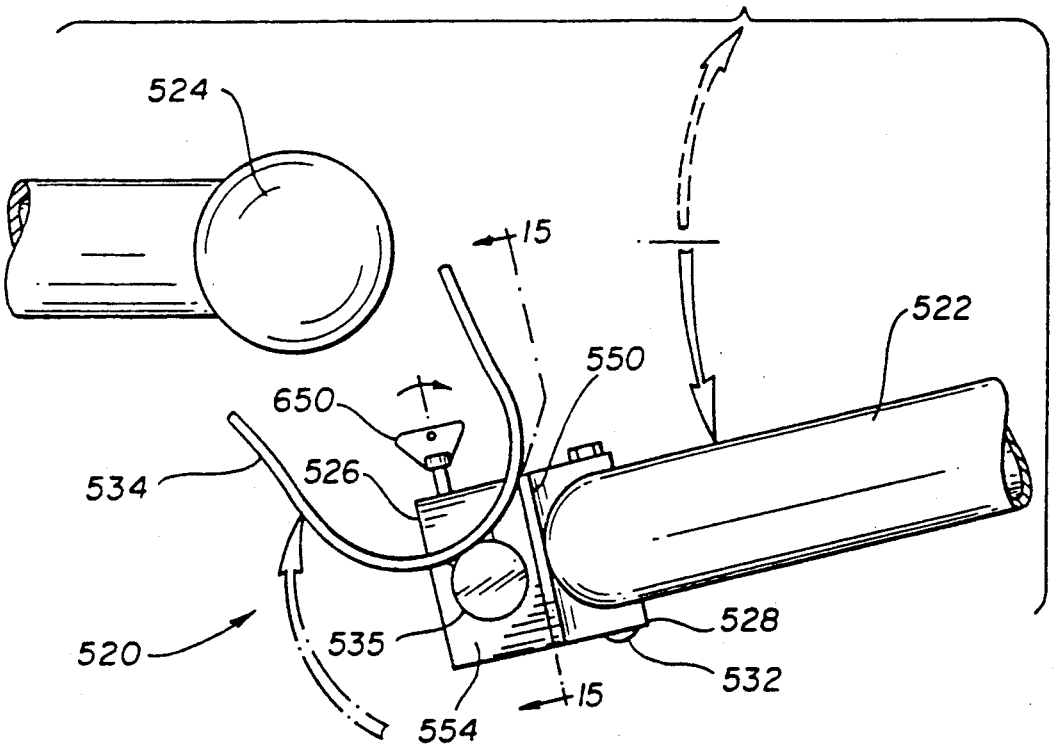
FIG. 12 is a top view of this embodiment to the gate latch of this invention in the unlocked position.
Figure 13:
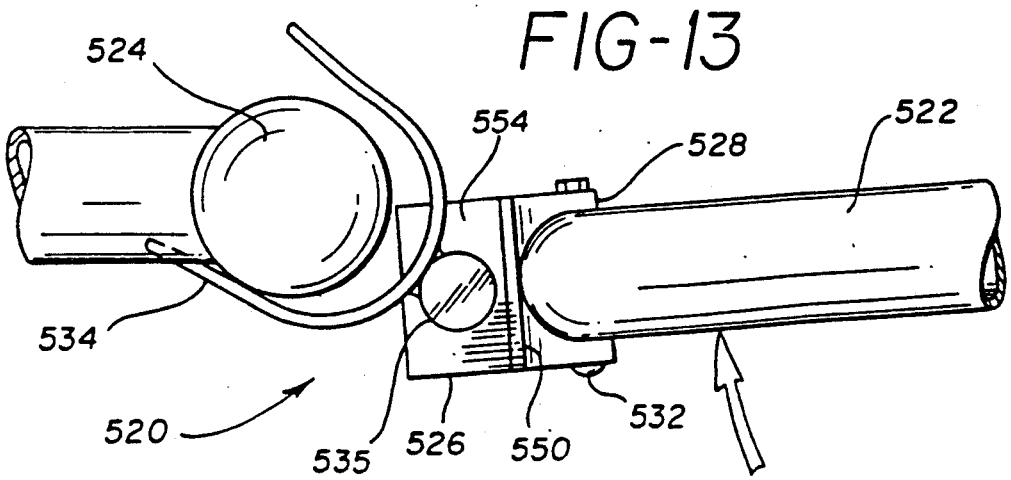
FIG. 13 is a top view of this embOdiment of the gate latch of this invention just prior to the gate being closed and entering the locked position.

Referring to FIGS. 10–18, particularly, FIGS. 10 and 11, the gate latch 520 of this invention is used for locking a hingeably mounted gate 522 to a latch post 524 of a fence (not shown). The gate latch 520 comprises a lock housing 526 and a mounting means, for example a mounting collar 528 for mounting the lock housing 526 to either the gate post 530 of gate 522 or optionally (not shown) the latch post 524. In its preferred embodiment as shown, the lock housing 526 is mounted to a gate post 530. Preferably the mounting collar 528 is mounted to the gate post 530 by a plurality of carriage bolts 532.

An oarlock or fork latch means 534 is pivotally mounted to the lock housing 526. The oarlock 534 is mounted on an oarlock shaft 536 and pivots about an axis (not shown) extending vertically through the oarlock shaft 36. (see FIGS. 15 and 18). The oarlock shaft has a first end 538 onto which is mounted the oarlock 534 and a second end 540 (see, for example, FIG. 15) which extends into and is pivotally mounted in the lock housing 526.

The oarlock 534 pivots in a horizontal plane between a first position, as shown, for example, in FIG. 11, wherein the oarlock 534 extends from the housing 526 to engage the post 524 when the gate is in a closed position. The oarlock 534 also pivots to a second position, as shown, for example, in FIG. 12, wherein the oarlock 534 is disengaged from the latch post 524 when the gate 522 is in an opened position.

Although the preferred embodiment of this invention requires the oarlock 534 to pivot in a horizontal plane it is possible to construct an embodiment of this invention which pivots in a vertical plane.

Broadly, a locking means is enclosed within the lock housing 526 for automatically locking the oarlock 534 in the first locked position when the oarlock 534 pivots from the second unlocked position to the first locked position, to prevent the oarlock 534 from pivoting further, and to lock the gate 522 in the closed position. Preferably, as the gate 522 swings from the open position (FIG. 12) to the closed position (FIG. 11) the interior of one side of the oarlock 534 contacts the latch post 524 (FIG. 13) to automatically pivot the oarlock 534 to the closed position while the gate 522 swings closed. Optionally, the gate may have a spring mechanism (not shown) of the type well known in the art, to automatically cause the gate 522 to swing closed. Such a gate when used in combination with the spring mechanism and gate latch 20 of this invention results in a gate that automatically swings closed and automatically locks without any assistance from the operator.

Figure 14:
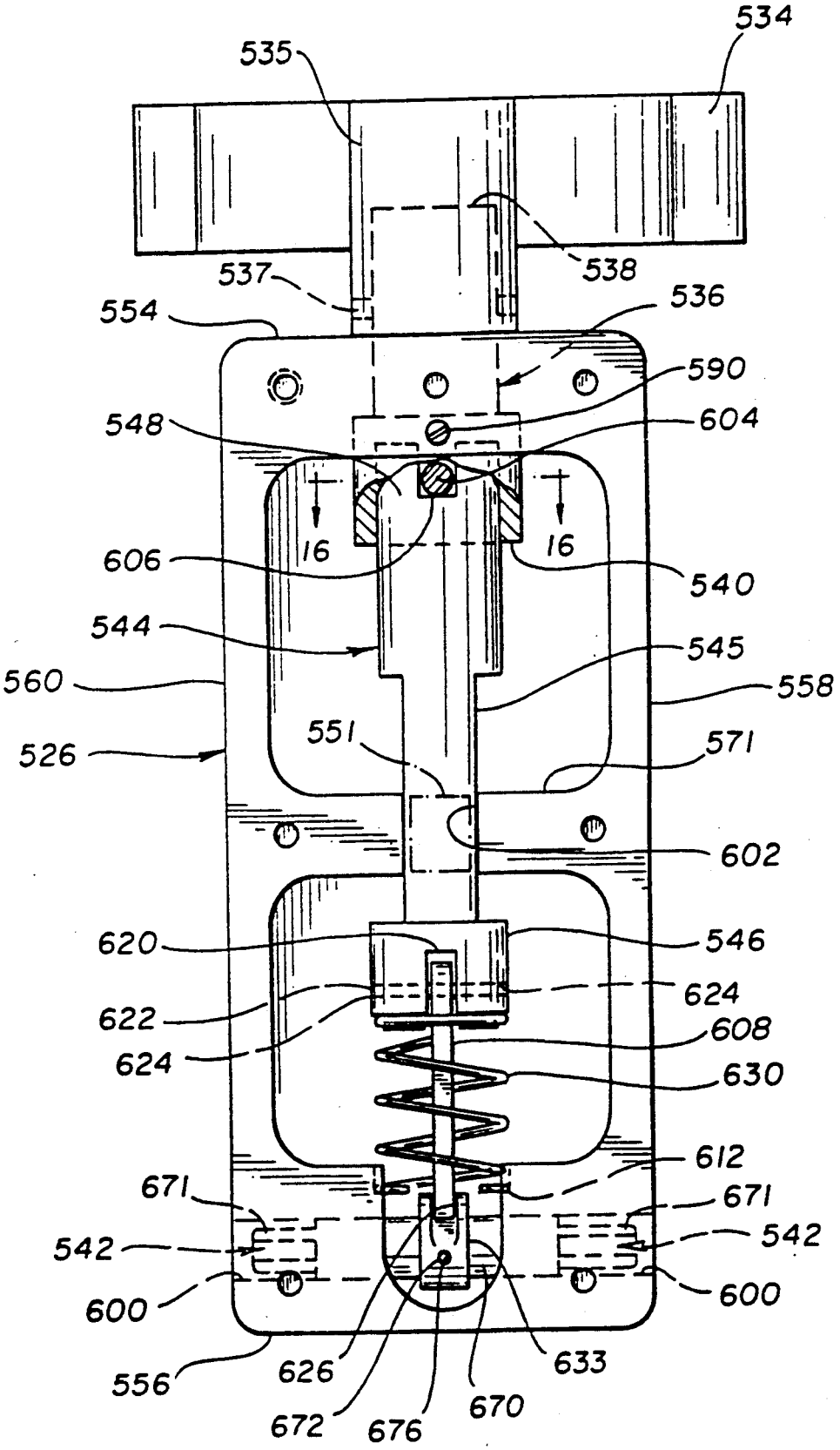
FIG. 14 is a cross sectional view of the gate latch of this invention in a locked position taken along line 14—14 of FIG. 11.
Figure 15:
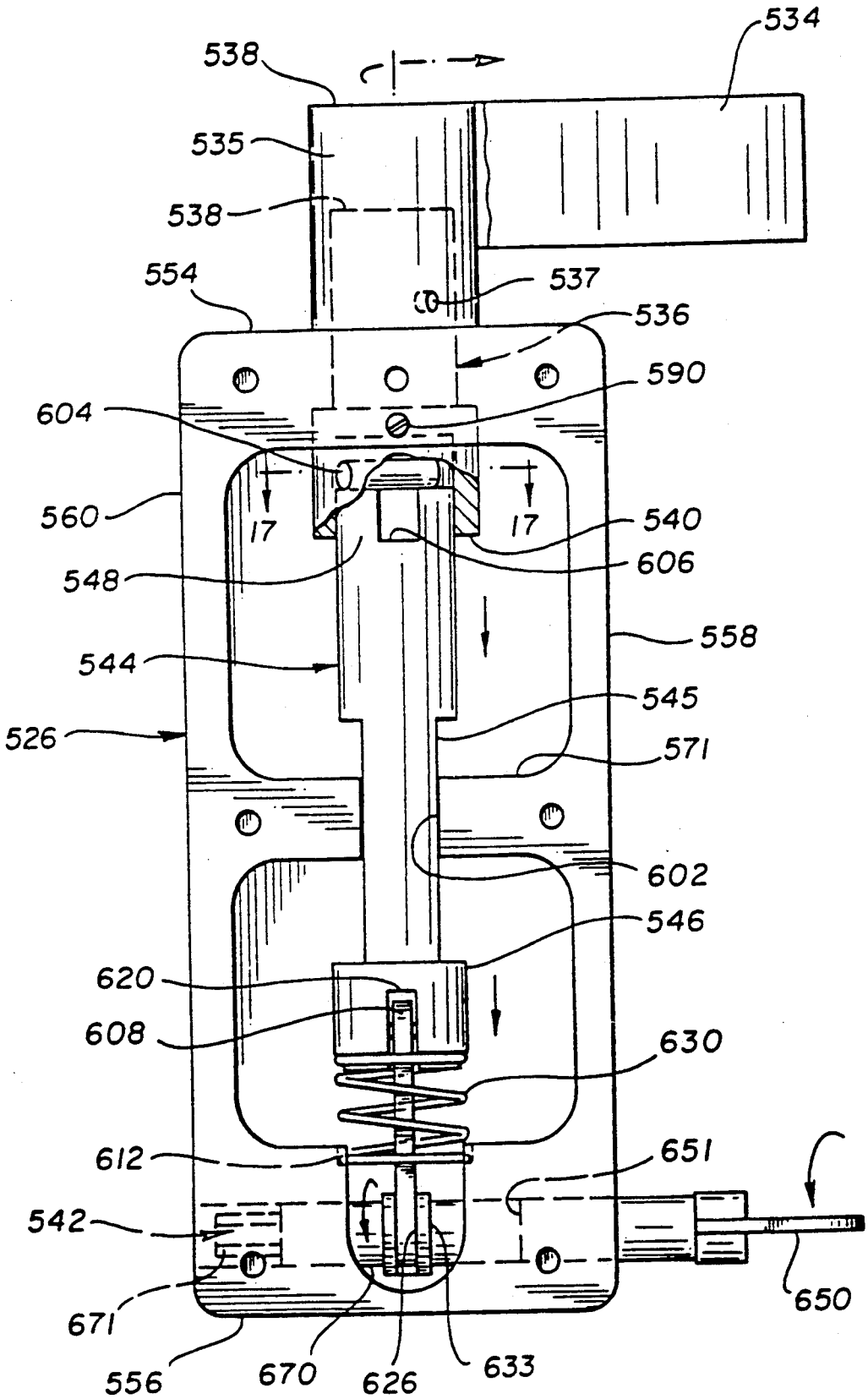
FIG. 15 is a partial cross sectional view of the gate latch of this invention in the unlocked position taken along line 15—15 of FIG. 12.
Figure 18:
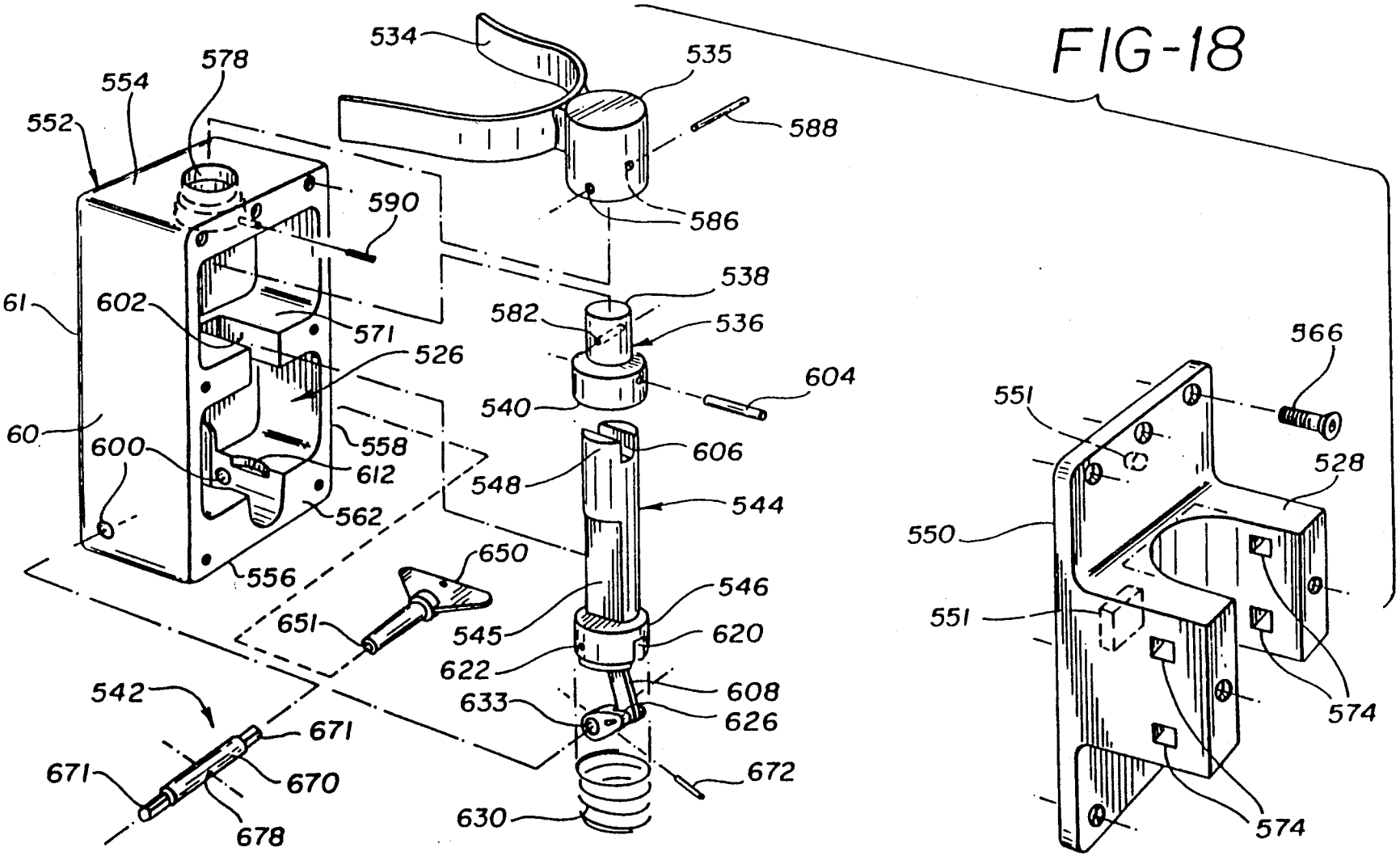
FIG. 18 is an exploded perspective view of this embodiment of the gate latch of this invention.

Referring to FIGS. 14, 15 and 18, the locking means included within the lock housing 526 comprises a key lock unit 542 for unlocking the oarlock 534 to permit the oarlock 534 to pivot from the first to the second position.

The key lock 542 is rotatable between a first locked position, as shown, for example, in FIG. 14, for automatically locking the oarlock 534 in the first position and a second unlocked position (see, for example, FIG. 15) to permit the oarlock 534 to pivot between the first and second positions. The locking means is designed so that they key lock 542 automatically returns to the first locked position from the second unlocked position when the key 650 is released.

Generally, within the lock housing 526 a lock bolt 544 is provided which has a first end 546 which coact with the key lock 542 and a second end 548 which is engageable with the second end 540 of oarlock shaft 536. The lock bolt 544 is urged by spring 630 into engagement with the second end 540 of oarlock shaft 536 except when key lock 542 is maintained in the second unlocked position by the application of constant pressure to the key 650.

Figure 16:
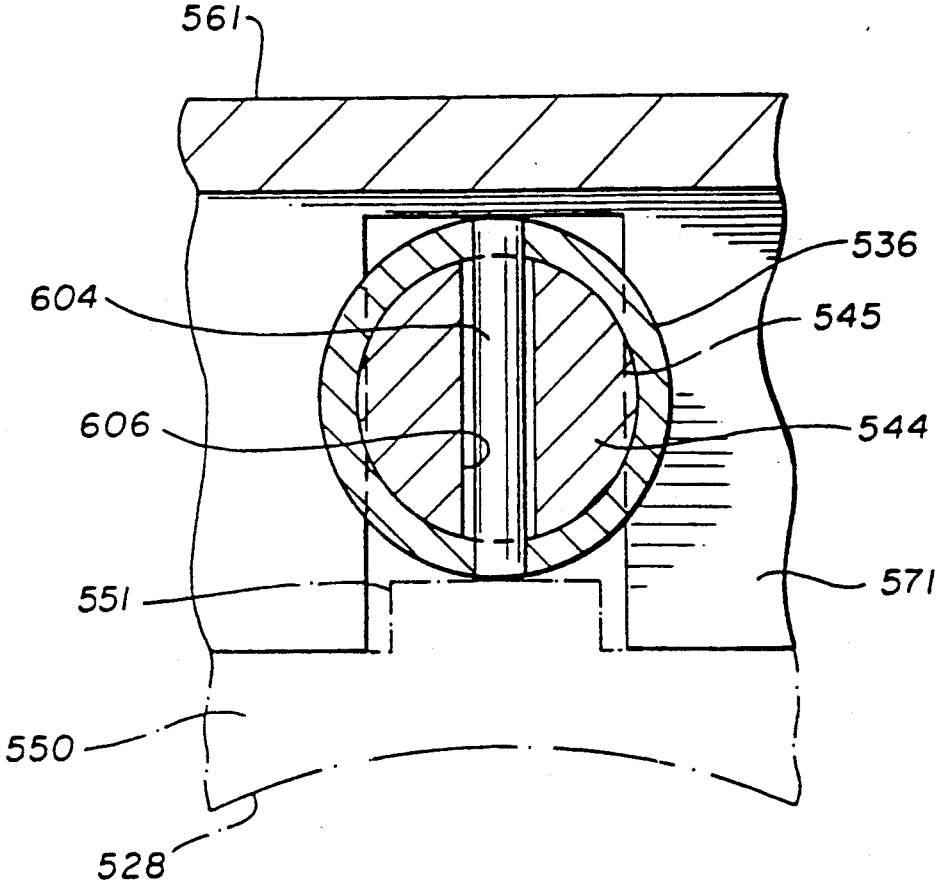
FIG. 16 is a partial cross sectional view of the gate latch of this invention in the locked position taken along line 16—16 of FIG. 14.
Figure 17:
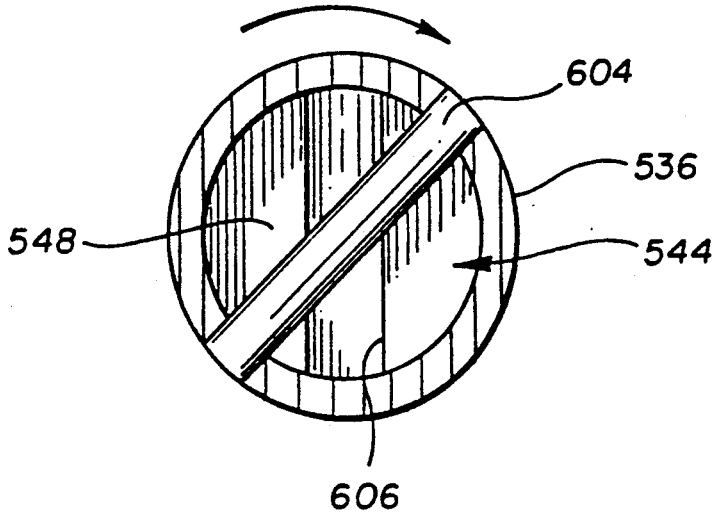
FIG. 17 is a partial cross-sectional view of the gate latch of this invention in the unlocked position taken along line 17—17 of FIG. 15.

Referring to FIG. 14 and 16, when the key lock 542 is in the first locked position, the second end 548 of the lock bolt 544 is engaged with or urged against the second end 540 of the oarlock shaft 536 to cause the locking of the oarlock 534 when the oarlock 534 is in the first locked position (See, for example, FIG. 15). When the lock bolt 544 is urged to the second unlocked position by urging the key 650 in the appropriate direction (See, for example, FIG. 15 and 17) the second end 548 of lock bolt 544 is disengaged from the second end 540 of the oarlock shaft 536 to thereby unlock the oarlock 534 and allow the oarlock 534 to pivot from the first locked position to the second unlocked position, thus permitting the gate 522 to open.

Referring to FIGS. 14–18, the lock housing 526 comprises a rear cover plate 550 mounted to an enclosure housing 552 having a top 554 and bottom 556, a left side 558 and a right side 560, and a front 561 and rear side 562. The rear cover plate 550 has thereon a sealant means, e.g. a polymeric coating thereon to prevent moisture and the elements from finding their way into the interior of the lock housing 526. The rear cover plate 550 is mounted to the enclosure housing 552 by a plurality of screws 566 which pass through the cover plate 550 and collar element 528 and threadably engage the rear side 562 to mount the rear cover plate 550 firmly to the enclosure housing 552.

Molded into the rear cover plate 550 is a mounting collar 528 collar elements. The collar element 528 has a plurality of holes 574 therein to permit carriage bolts 532 to pass through the collar element 528 and through holes that are drilled (not shown) in post 530, so that the collar 528 may thereby to be secured to gate post 530.

Referring to FIGS. 14, 15 and 18, mounted to the top of oarlock shaft 536 and attached to oarlock 534 and above housing 522 is retainer cap 535. Cap 535 is permanently secured to the oarlock 534, by for example welds between the cap 535 and the oarlock 534 and overlies mounting hole 578 which passes through the top surface 554 of enclosure housing 552. Cap 535 assists in preventing moisture, dust, etc. from the environment from entering into the lock housing 526.

Passing through cap 535 are diametric retaining holes 586. Oarlock shaft 536 has passing therethrough retaining hole 582. Retaining holed 582 in oarlock shaft 536 aligns with retaining holes 586 in cap 535 to permit a retaining pin 588 to secure the oarlock shaft 536 within cap 535.

An adjustment screw 590 passes through housing wall 526 to bear against shaft 536 to control the pivot motion of shaft 536.

Referring to FIGS. 14-18, lock bolt 544 slidably passes through opening 602 in retainer plate 571. Plate 571 is retained in the enclosure housing 552 by being welded therein along the periphery of the retainer plate 571 or alternatively, retainer plate 571 may be integrally molded with the housing 526, as shown.

At the end of oarlock shaft 536 is a collar 540 which has a pin 604 which extends therein, and which matingly engages with slot 606 at the second end 548 of lock bolt 544.

Referring to FIGS. 14, 15 and 18, at the first end 546 of lock bolt 544 a slot 620 is provided which has passing perpendicular therethrough a lock bolt pin 622 which is retained therein by lock bolt pin holes 624 in each shoulder of slot 620. Lock bolt pin 622 passes through a hole at the upper end of lock bolt arm 608 to pivotally attach lock bolt arm 608 to lock bolt 544. Attached to the lower end of lock bolt arm 608 is connecting shaft 670.

Surrounding lock bolt arm 608 is spring 630 which at one end rests upon spring retainer shoulders 612, and at the other end, urges look bolt 544 upward towards the second end 540 of oarlock shaft 536, to urge the engagement of pin 604 into slot 606 in lock bolt 544.

Lock bolt pin 622 matingly engages the hole in lock bolt arm 608. Lock bolt arm 608 coact with key lock unit 542 in such a manner that when the key lock 542 is rotated between the first locked position (for automatically locking the oarlock 534 in the first position) and the second unlocked position (to permit the oarlock 534 to pivot between the first and second positions), the lock bolt arm 608 causes lock bolt pin 622 to raise or lower the lock bolt 544 to cause the slot 606 in lock bolt 544 to engage or disengage from the pin 604 at the second end 540 of oarlock shaft 536. Spring 630 urging against first end 546 of lock bolt 544 causes the lock bolt 544 to be constantly urged against the second end 540 of oarlock shaft 536 unless urged downward by the lock bolt arm 608.

Referring to FIGS. 14–18, key lock unit 542 comprises an insert configured lock shaft 670 whose end 671 is configured to mate with the end of key 650. An opening 600 is provided through each of the sides 558, 560 of the lock housing 526. The shaft 670 passes through opening 633 in cam 626. Cam 626 is maintained on shaft 670 by retaining pin 672 passing through cam retainer hole 676 in cam 626 and center hole 678 on shaft 670.

In use, lock bolt arm 608 is automatically urged by spring 630 to raise lock bolt 544 so that the slot 606 in lock bolt 544 is urged to engage pin 604. As oarlock 534 is pivoted from the second unlocked position to the first locked position, pin 604 rotates until pin 604 engages slot 606. At this point, the oarlock 534 is in a first locked position engaging latch post 524. When the key 650 is rotated in the opposite direction cam 626 moves lock bolt arm 608 downward to lower lock bolt 544 against spring 630 to disengage pin 604 from slot 606 thus permitting the oarlock means to pivot from the first locked position to the second unlocked position, thereby permitting the gate to open. When the key is released the lock bolt 544 is urged against the second end 540 of oarlock shaft 536, pin 604 overlying slot 606 and preventing engagement therebetween. (See FIGS. 16 and 17)

The foregoing device has many advantages, i.e. simplicity of construction, simplicity of use, and it permits a wire mesh gate to be automatically locked when swung closed.

While the invention has been described in its preferred embodiments, it is to be understood that the words which have been used are words of description rather than limitation and that changes may be made within the purview of the appended claims without departing from the true scope and spirit of the invention in its broader aspects.

I claim:

1. A gate latch for locking a hingedly mounted gate to a latch post comprising:

a lock housing;

mounting means attached to the housing for mounting the housing to a gate or post;

an oarlock means comprising an oarlock shaft having a first end mounted to an oarlock and a second end extending into and pivotally mounted to the housing, the oarlock means pivotal between a first position and a second position, wherein when the oarlock is in the first position the oarlock extends from the housing to engage the other of the gate or post when the gate is in a closed position, and when the oarlock is in the second position it is disengaged from the other of the gate or post when the gate is in an opened position;

locking means disposed within the lock housing for automatically locking the oarlock in the first position when the oarlock pivots from the second position to the first position, the locking means including a key lock means accessible from the exterior of the lock housing for unlocking the locking means, the key lock means rotatable between a first locked position for automatically locking the oarlock in the first position and a second unlocked position to permit the oarlock to pivot between the first and second position, wherein the key lock means is normally biased to the first locked position;

a lock bolt having a first end coacting with and mounted to the key lock means and a second end engageable with the second end of the oarlock shaft;

wherein when the key lock is in the first locked position the second end of the lock bolt is urged against the second end of the oarlock shaft to, when the oarlock is in the first position, automatically engage the second end of the oarlock shaft and lock the oarlock in the first position, and when the key lock is in the second unlocked position the second end of the lock bolt is disengaged from the second end of the oarlock shaft to thereby unlock the oarlock and permit pivotal movement of the oarlock;

spring biasing means disposed within the lock housing for urging the lock bolt against the second end of the oarlock shaft; and cam means interconnecting the key lock means with a lock bolt arm, the lock bolt arm attached to the first end of the lock bolt;

wherein, when the key lock means is rotated from the first locked position to the second unlocked position, the cam means translates the rotational motion of the key lock means into vertical movement of the lock bolt arm, the lock bolt arm moving the lock bolt shaft against the spring bias means to move the second end of the lock bolt shaft away from the second end of the oarlock shaft.

2. The gate latch of claim 1, wherein the mounting means comprises a mounting collar having a plurality of apertures for permitting bolts to extend through the mounting collar and through holes drilled in either of the gate or post to which the gate latch is mounted.

3. A gate latch for locking a gate to a latch post having a frame and being pivotally mounted for movement between an open position and a closed position, the gate being normally biased to the closed position and the frame of the gate being in close proximity to a latch post, the gate latch comprising:

a lock housing;

mounting means attached to the housing for mounting the housing to the gate or the post;

an oarlock means comprising an oarlock shaft having a first end mounted to an oarlock and a second end extending into and pivotally mounted to the housing, the oarlock means pivotally mounted to the housing, the oarlock means pivotal between a first position and a second position, wherein when the oarlock is in the first position the oarlock extends from the housing to engage the other of the gate or post when the gate is in a closed position, and when the oarlock is in the second position it is disengaged from the other of the gate or post when the gate is in an opened position;

locking means disposed within the lock housing for automatically locking the oarlock in the first position when the oarlock pivots from the second position to the first position, wherein the locking means includes key lock means, accessible from the exterior of the lock housing, for unlocking the locking means;

wherein the key lock means is rotatable between a first locked position for automatically locking the oarlock in the first position and a second unlocked position to permit the oarlock to pivot between the first and second positions;

wherein the key lock means is normally biased to the first locked position;

a lock bolt having a first end coacting with the key lock means and a second end engageable with the second end of the oarlock shaft;

wherein when the key lock is in the first locked position, the second end of the lock bolt is urged against the second end of the oarlock shaft to, when the oarlock is in the first position, automatically engage the second end of the oarlock shaft and lock the oarlock in the first position, and when the lock bolt is in the second unlocked position the second end of the lock bolt is disengaged from the second end of the oarlock shaft to thereby unlock the oarlock and permit the pivotal movement of the oarlock;

wherein, after the gate is opened and the gate automatically moves from the opened position to the closed position, the oarlock contacts the other of the gate or post to pivotally move the oarlock from the opened position to the closed first position where it automatically locks the oarlock in the closed position thereby locking the gate in the closed position.

4. A combination spring gate and gate latch for locking a gate to a latch post comprising:

a gate comprising a frame, the gate being pivotally mounted for movement between an open position and a closed position, the gate being normally biased to the closed position wherein the frame of the gate is in close proximity to a latch post;

a gate latch comprising:

a lock housing:

mounting means attached to the housing for mounting the housing to the gate or the post;

an oarlock means comprising an oarlock shaft having a first end mounted to an oarlock and a second end extending into and pivotally mounted to the housing, the oarlock means pivotally mounted to the housing, the oarlock means pivotal between a first position and a second position, wherein when the oarlock is in the first position the oarlock extends from the housing to engage the other of the gate or post when the gate is in a closed position, and when the oarlock is in the second position it is disengaged from the other of the gate or post when the gate is in an opened position;

locking means disposed within the lock housing for automatically locking the oarlock in the first position when the oarlock pivots from the second position to the first position, wherein the locking means includes key lock means, accessible from the exterior of the lock housing, for unlocking the locking means;

wherein the key lock means is rotatable between a first locked position for automatically locking the oarlock in the first position and a second unlocked position to permit the oarlock to pivot between the first and second positions;

wherein the key lock means is normally biased to the first locked position;

a lock bolt having a first end coacting with the key lock means and a second end engageable with the second end of the oarlock shaft;

wherein when the key lock is in the first locked position, he second end of the lock bolt is urged against the second end of the oarlock shaft to, when the oarlock is in the first position, automatically engage the second end of the oarlock shaft and lock the oarlock in the first position, and when the lock bolt is in the second unlocked position the second end of the lock bolt is disengaged from the second end of the oarlock shaft to thereby unlock the oarlock and permit the pivotal movement of the oarlock;

wherein, after the gate is opened, it automatically moves from the opened position to the closed position, the oarlock contacting the other of the gate or post to pivotally move the oarlock from the opened position to the closed first position where it automatically locks the oarlock in the closed position thereby locking the gate in the closed position.

5. The combination spring gate latch of claim 3, further comprising:

spring biasing means disposed within the lock housing for urging the lock bolt against the second end of the oarlock shaft; and cam means interconnecting the key lock means with a lock bolt arm, the lock bolt arm attached to the first end of the lock bolt;

wherein, when the key lock means is rotated from the first locked position to the second unlocked position, the cam means translates the rotational motion of the key lock means into vertical movement of the lock bolt arm, the lock bolt arm moving the lock bolt shaft against the spring bias means to move the second end of the lock bolt shaft away from the second end of the oarlock shaft.

6. A combination spring gate and gate latch of claim 3, wherein the mounting means comprises a mounting collar having a plurality of apertures for permitting bolts to extend through the mounting collar and through holes drilled in either of the gate or post to which the gate latch is mounted.

7. A gate latch for locking a hingedly mounted gate to a latch post comprising:

a lock housing;

mounting means attached to the housing for mounting the housing to a gate or post;

an oarlock means comprising an oarlock shaft having a first end mounted to an oarlock and a second end extending into and pivotally mounted to the housing, the oarlock means pivotal between a first position and a second position, wherein when the oarlock is in the first position the oarlock extends from the housing to engage the other of the gate or post when the gate is in a closed position, and when the oarlock is in the second position it is disengaged from the other of the gate or post when the gate is in an opened position;

locking means disposed within the lock housing for automatically locking the oarlock in the first position when the oarlock pivots from the second position to the first position, the locking means including a key lock means accessible from the exterior of the lock housing for unlocking the locking means, the key lock means rotatable between a first locked position for automatically locking the oarlock in the first position and a second unlocked position to permit the oarlock to pivot between the first and second position, wherein the key lock means is normally biased to the first locked position;

a lock bolt having a first end coacting with and mounted to the key lock means and a second end engageable with the second end of the oarlock shaft;

wherein when the key lock is in the first locked position the second end of the lock bolt is urged against the second end of the oarlock shaft to, when the oarlock is in the first position, automatically engage the second end of the oarlock shaft and lock the oarlock in the first position, and when the key lock is in the second unlocked position the second end of the lock bolt is disengaged from the second end of the oarlock shaft to thereby unlock the oarlock and permit pivotal movement of the oarlock;

spring biasing means disposed within the lock housing for urging the lock bolt against the second end of the oarlock shaft; and cam means interconnecting the key lock means with a lock bolt arm, the lock bolt arm attached to the first end of the lock bolt;

wherein, when the key lock means is rotated from the first locked position to the second unlocked position, the cam means translates the rotational motion of the key lock means into movement of the lock bolt arm, the lock bolt arm moving the lock bolt shaft against the spring bias means to move the second end of the bolt shaft away from the second end of the oarlock shaft.

8. A combination spring gate and gate latch for locking a gate to a latch post comprising:

a gate comprising a frame, the gate being pivotally mounted for movement between an open position and a closed position, the gate being normally biased to the closed position wherein the frame of the gate is in close proximity to a latch post:

a gate latch comprising:

a lock housing:

mounting means attached to the housing for mounting the housing to the gate or the post:

an oarlock means comprising an oarlock shaft having a first end mounted to an oarlock and a second end extending into and pivotally mounted to the housing, the oarlock means pivotally mounted to the housing, the oarlock means pivotal between a first position and a second position, wherein when the oarlock is in the first position the oarlock extends from the housing to engage the other of the gate or post when the gate is in a closed position, and when the oarlock is in the second position it is disengaged from the other of the gate or post when the gate is in an opened position:

locking means disposed within the lock housing for automatically locking the oarlock in the first position when the oarlock pivots from the second position to the first position, wherein the locking means includes key lock means, accessible from the exterior of the lock housing, for unlocking the locking means;

wherein the key lock means is rotatable between a first locked position for automatically locking the oarlock in the first position and a second unlocked position to permit the oarlock to pivot between the first and second positions;

wherein the key lock means is normally biased to the first locked position;

wherein, after the gate is opened, the gate automatically moves from the opened position to the closed position, the oarlock contacting the other of the gate or post to pivotally move the oarlock from the opened position to the closed first position where it automatically locks the oarlock in the closed position thereby locking the gate in the closed position.

* * * * *